United States Patent [19]

Kilminster et al.

[11] Patent Number: 4,753,871

[45] Date of Patent: Jun. 28, 1988

[54] CYAN DYE-FORMING COUPLERS AND PHOTOGRAPHIC MATERIALS CONTAINING SAME

[75] Inventors: Kenneth N. Kilminster; David Hoke, both of Rochester, N.Y.

[73] Assignee: Eastman Kodak Company, Rochester, N.Y.

[21] Appl. No.: 940,831

[22] Filed: Dec. 12, 1986

[51] Int. Cl.[4] ..... G03C 7/34; G03C 7/38

[52] U.S. Cl. ..... 430/552; 430/553

[58] Field of Search ..... 430/552, 553

[56] References Cited

U.S. PATENT DOCUMENTS

| | | | |
|---|---|---|---|
| 4,333,999 | 6/1982 | Lau | 430/552 |
| 4,434,225 | 2/1984 | Sugita et al. | 430/552 |
| 4,513,079 | 4/1985 | Sakanoue et al. | 430/553 |
| 4,518,683 | 5/1985 | Kato et al. | 430/552 |

*Primary Examiner*—Roland E. Martin
*Assistant Examiner*—Lee C. Wright
*Attorney, Agent, or Firm*—Thomas F. Kirchoff

[57] ABSTRACT

Novel phenolic cyan dye-forming couplers contain a p-cyanophenylureido group in the 2-position and in the 5-position an acylamino group containing bulky alicyclic or heterocyclic substituents sufficient to provide steric interaction within the coupler molecule and the dye molecule derived therefrom. The couplers are useful in photographic emulsions.

11 Claims, No Drawings

CYAN DYE-FORMING COUPLERS AND PHOTOGRAPHIC MATERIALS CONTAINING SAME

The present invention relates to novel phenolic cyan dye-forming couplers and to photographic elements containing such couplers.

Couplers which are used to obtain cyan dyes for color photography are typically phenols and naphthols. These couplers yield azomethine dyes upon coupling wih oxidized aromatic primary amino color developing agents.

U.S. Pat. No. 4,333,999 describes cyan phenolic couplers which comprise a p-cyanophenylureido group in the 2-position of the phenolic ring. This class of couplers has found wide commercial acceptance in photographic applications. Included among the important advantages of these couplers is their ability to provide cyan dyes of excellent purity with hue values which are shifted bathochromically to the long wavelength red absorption region, well beyond 650 nm. This latter property provides dyes in which unwanted green light absorption is minimized.

However, even with these couplers, which have found extensive utility, further improvements in coupler reactivity and enhanced dye absorption continue to be sought. For example, it has been difficult to obtain, with the same coupler, both high coupling effectiveness and a cyan dye of the desired hue purity with long wavelength red absorption. Coupling effectiveness is measured for each coupler of this invention by comparing the gamma or contrast of its dye image sensitometric test curve with that of a control coupler under identical conditions.

Inasmuch as the coupler structures of the U.S. Pat. No. 4,333,999 do not provide a combination of essential moieties which improve coupling effectiveness while maintaining the desired bathochromic shift and hue purity in subsequently obtained cyan dye, there is a continuing search for couplers which can provide these desirable properties.

In the present invention these objectives are attained by providing a bulky alicyclic or heterocyclic ring system in the 5-position acylamino ballast group on cyan phenolic couplers of the general type described in the above-mentioned U.S. Pat. No. 4,333,999. Such bulky cyclic groups, through steric interaction with the coupler molecule and the image dye derived therefrom, are believed capable of directing the molecule into conformations favorable for conferring the desired spectral absorption properties while simultaneously allowing sufficient coupling effectiveness.

Coupler compounds which fulfill the requirements noted above, and which fall within this invention, have the following structural formula:

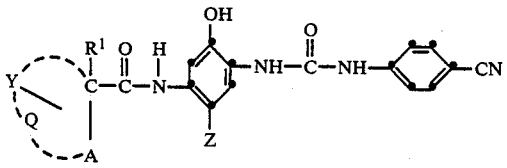

wherein:

$R^1$ is hydrogen or an unsubstituted or substituted alkyl group having from 1 to about 20 carbon atoms;

Q represents the nonmetallic atoms needed to complete an alicyclic or heterocyclic ring system which comprises 1 to 3 rings each having from 4 to 7 atoms in the ring;

A, which represents a ring member bonded to the same carbon atom as is $R^1$, is either $$-\overset{|}{N}-R^2 \text{ or } -\underset{\underset{R^4}{|}}{\overset{|}{C}}-R^3;$$

$R^2$ is an unsubstituted or substituted alkyl group having from 1 to about 24 carbon atoms, a cycloalkyl group having from 3 to 8 carbon atoms in the ring, an aryl group having from 6 to about 24 carbon atoms, or a heterocyclic group having from 3 to 8 atoms in the heterocyclic ring where the hetero ring atoms can be nitrogen, oxygen or sulfur, or $R^2$ is $L—R^5$;

$R^3$ is as defined for $R^2$ or is halogen;

$R^4$ is as defined for $R^2$ or is hydrogen or halogen;

$R^5$ is an unsubstituted or substituted alkyl group having from 1 to about 24 carbon atoms, a cycloalkyl group having from 3 to 8 carbon atoms in the ring, an aryl group having from 6 to about 24 carbon atoms or a heterocyclic group having from 3 to 8 atoms in the heterocyclic ring where the hetero ring atoms can be nitrogen, oxygen or sulfur, L is —CO—, —COO—, $—SO_2—$, $—CONR^6—$ or $—SO_2NR^6—$;

$R^6$ is as defined for $R^5$ or is hydrogen;

Y represents one or more substituents which individually can be halogen, hydroxy, amino, including substituted amino where one or both hydrogen atoms are replaced with an alkyl group having from 1 to about 10 carbon atoms or with an aryl group having from 6 to about 10 carbon atoms, cyano, nitro, carboxy, sulfo, or is as defined for $R^2$; and Z is hydrogen or a coupling-off group.

Preferred coupler compounds which provide the desirable combination of increased coupling effectiveness with improved cyan dye hues in the long wavelength red region of the visible spectrum include those of the above structure formula where $R^1$ is hydrogen or an alkyl group having from 1 to about 12 carbon atoms;

Q represents carbon, oxygen and nitrogen atoms sufficient to complete a 5 or 6 membered ring; and A is $$-\underset{\underset{R^4}{|}}{\overset{|}{C}}-R^3.$$

Especially preferred coupler compounds include those where Q and A together complete a cyclohexyl or butyrolactone ring and those where $R^1$ is hydrogen or methyl.

Coupling off groups defined by Z are well known to those skilled in the art. Such groups can determine the equivalency of the coupler i.e, whether it is a 2-equivalent coupler or a 4-equivalent coupler. Such groups can also modify the reactivity of the coupler or can advantageously affect the layer in which the coupler is coated, or other layers in a photographic recording material, by performing, after release from the coupler, such functions as development inhibition, bleach inhibition, bleach acceleration, color correction and the like.

Representative classes of coupling-off groups include alkoxy, aryloxy, heteroyloxy, sulfonyloxy, acyloxy, acyl, heterocyclyl, sulfonamido, phosphonyloxy and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Examples of preferred coupling-off groups which can be represented by Z are:

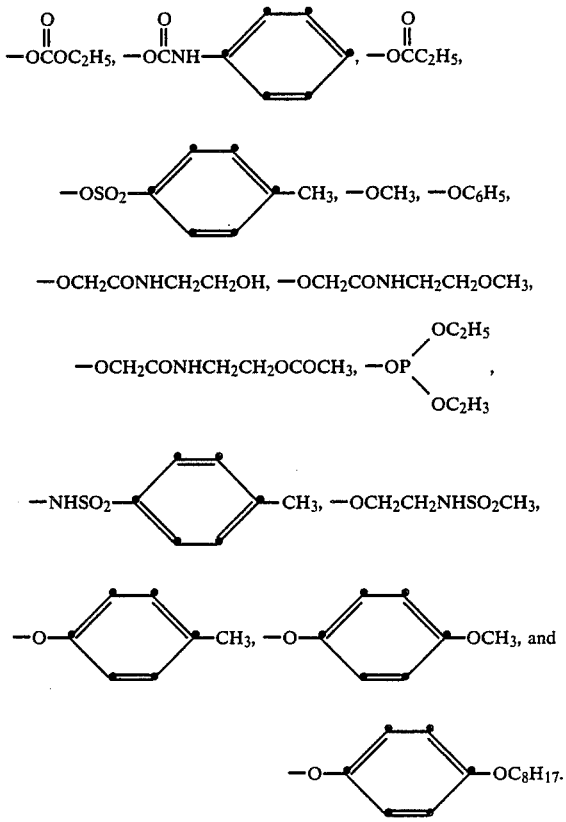

Especially preferred Z groups are hydrogen and

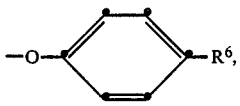

where $R^6$ is an alkyl or an alkoxy group having from 1 to about 10 carbon atoms.

Specific coupler compounds of this invention are shown below in Table I with reference to the following structural formula:

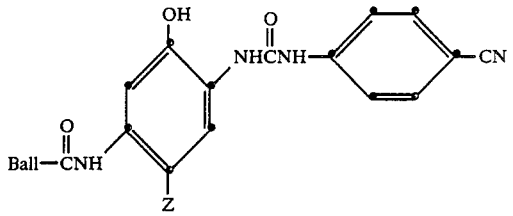

TABLE I

| Coupler | Ball | Z* |
|---|---|---|
| 1 | 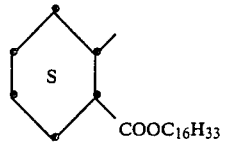 | A |
| 2 | 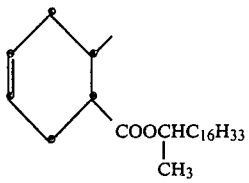 | B |
| 3 | 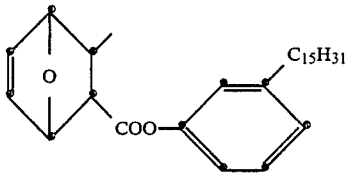 | A |
| 4 | 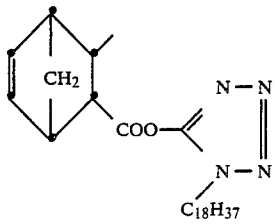 | H |
| 5 | 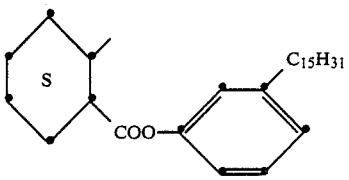 | A |
| 6 | 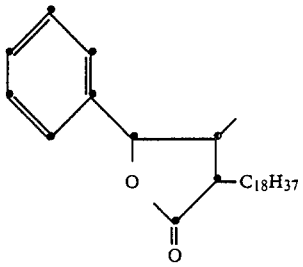 | A |

TABLE I-continued

| Coupler | Ball | Z* |
|---|---|---|
| 7 | 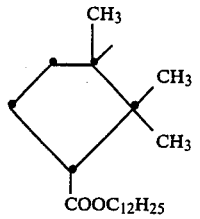 | A |
| 8 | 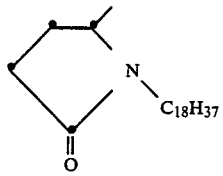 | B |
| 9 | 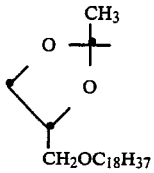 | A |
| 10 | 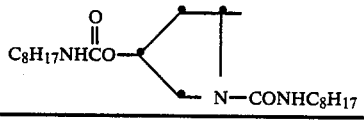 | H |

*A represents 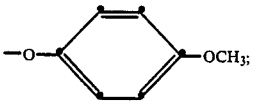

*B represents 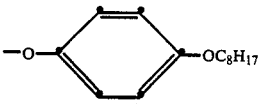

Coupler compounds of this invention can be prepared by reacting p-cyanophenylisocyanate with an appropriate aminophenol, such as 2-amino-5-nitrophenol or 2-amino-4-chloro-5-nitrophenol to form the 2-(p-cyanophenyl)ureido coupler moiety compound. The nitro group can then be reduced to an amine and a separately prepared ballast moiety can be attached thereto by conventional procedures. Two-equivalent couplers can be prepared by known techniques, for example, by substitution of a 4-chloro group on the starting phenol. Details of such preparations are noted below relative to specific coupler compounds identified in Table I.

SYNTHESIS 1

Coupler Compound No. 5 was prepared according to the following scheme:

A. Preparation of phenolic coupler moiety

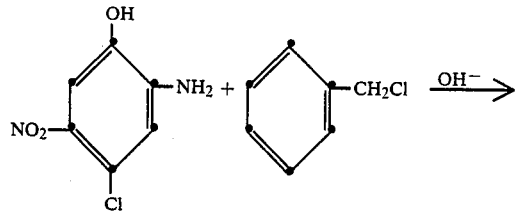

(S-1)

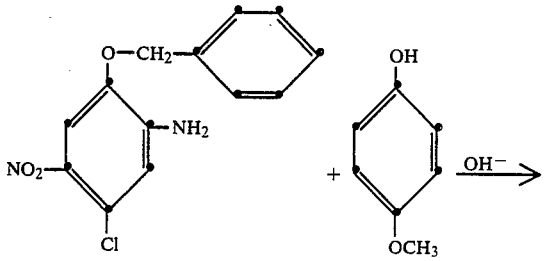

(S-2)

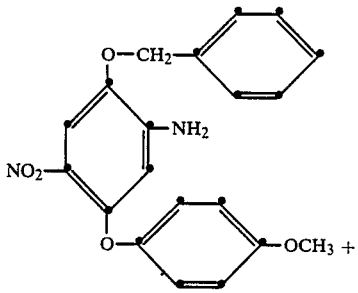

(S-3)

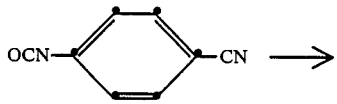

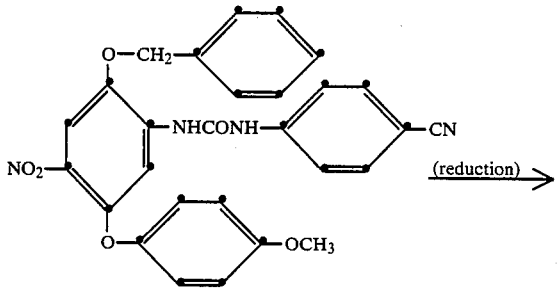

(S-4)

-continued

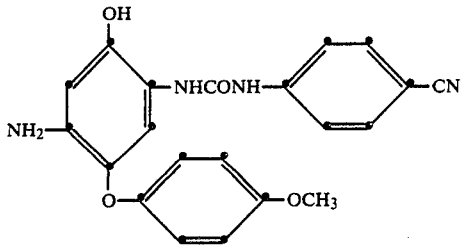

(S-5)

Preparation of 2-(p-cyanophenylureido)-4-p-methoxyphenoxy-5-aminophenol (S-5)

To a refluxing solution of 33.7 g (0.2 mol) 2-amino-4-chloro-5-nitrophenol (S-1) and 12.8 g (0.2 mol) potassium hydroxide in 300 ml acetone was added over a 3 hour period 25.3 g (0.2 mol) α-chlorotoluene. After an additional 6 hour reflux, the mixture was concentrated and added to cold potassium carbonate solution. The resulting precipitate was washed, dried, and recrystallized from xylene to yield 44.8 g yellow-green solid S-2, m.p. 131°.

A solution of 9.4 g (0.076 mol) p-methoxyphenol and 3.4 g (0.076 mol) potassium hydroxide in 200 ml toluene was refluxed to remove the aqueous azeotrope, then cooled to 40°. Then 40 ml dimethyl sulfoxide and 12 g (0.043 mol) S-2 were added sequentially and the mixture was heated gradually and refluxed 1 hour. The cooled reaction mixture was washed with water and sodium carbonate solution, dried over magnesium sulfate and treated with carbon. The solid obtained by cooling and filtering was washed with toluene and hexane then dried to yield 11.5 g S-3.

This product was converted to S-4 by treatment with equimolar p-cyanophenylisocyanate according to a procedure analogous to that described in Example 1 of U.S. Pat. No. 4,333,999, the disclosure of which is incorporated herein by reference.

A suspension of 7.6 g (11.5 mmol) nitro compound S-4 in 150 ml ethylacetate was shaken overnight with 2 g 10% palladium on carbon catalyst and 1.0 ml acetic acid under 40 lb hydrogen pressure to provide the aminophenol S-5.

B. Preparation of ballast moiety

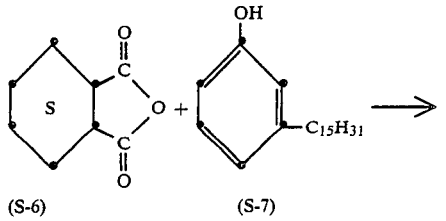

(S-6) (S-7)

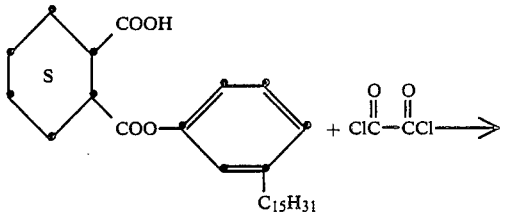

(S-8)

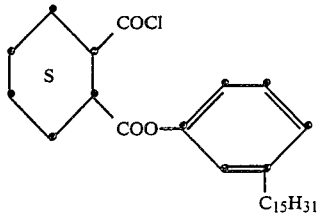

(S-9)

Preparation of 3-pentadecylphenyl 2-chloroformyl-1 cyclohexanecarboxyate (S-9)

To a suspension of 15.4 g (0.1 mol) 1,2-cyclohexanedicarboxylic anhydride (S-6) and 30.5 g (0.1 mol) m-pentadecylphenol (S-7) in 25 ml ethyl ether was added 0.5 ml concentrated sulfuric acid and the mixture stirred 5 hours at 100°. A gummy product was extracted with ligroin (b.p. 35°-50°), the extracts concentrated, and the residue triturated with aceto-itrile to yield 7 g S-8 as colorless crystals. Then 3.7 g (29.6 mmol) oxalyl chloride and 10 drops of dimethylformamide were added to a stirred solution of 6.8 g (14.8 mmol) S-8 acid in 150 ml dichloromethane. After 1 hour the mixture was concentrated to yield the acid chloride S-9 as a yellow oil.

C. Coupler formation

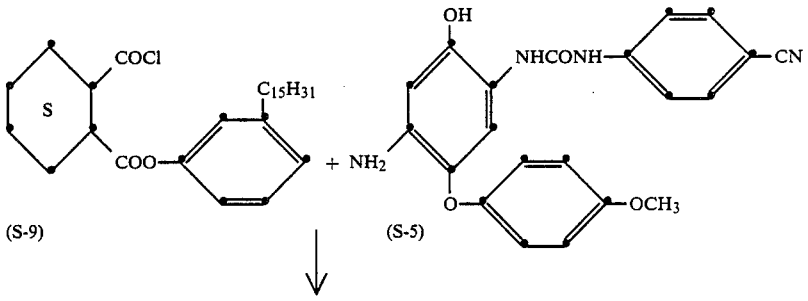

(S-9) (S-5)

-continued

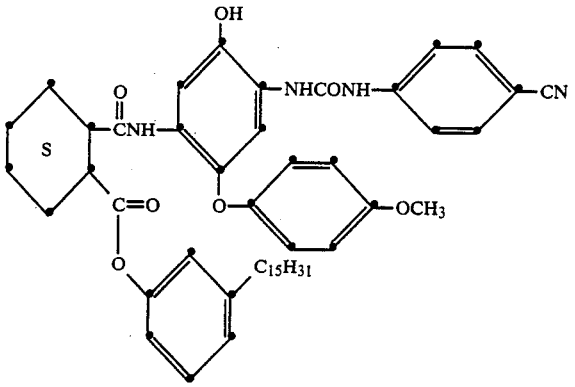

Coupler Compound No. 5

Preparation of Coupler Compound No. 5

Under a nitrogen atmosphere 5.8 g (14.8 mmol) phenolic coupler moiety S-5, 5.4 g (44.4 mmol) dimethylaniline and 14.8 mmol S-9 acid chloride were mixed in 300 ml ethyl acetate and stirred for 30 minutes. Washing with dilute hydrochloric acid, purification through silica gel, and crystallization from acetonitrile yielded 6.2 g Coupler Compound No. 5, m.p. 148°-149°. Identity of the product was confirmed by elemental analysis, nmr and mass spectra.

SYNTHESIS 2

Preparation of Coupler Compound No. 6 was carried out according to the following scheme:

A. Preparation of ballast moiety

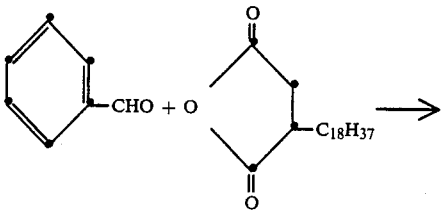

(S-10) (S-11)

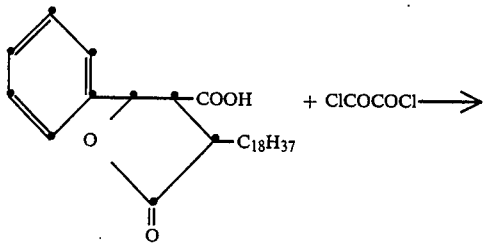

(S-12)

-continued

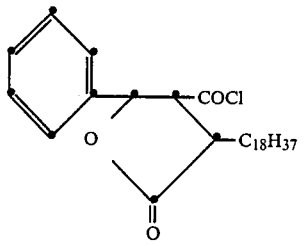

(S-13)

Preparation of ballasted intermediate compound S-13

To a stirred suspension of 15 g (110 mmol) zinc chloride and 1 ml thionyl chloride in 200 ml dichloromethane was added a solution of 25 g (75 mmol) octadecylsuccinic anhydride (S-11) and 5 g (50 mmol) benzaldehyde (S-10). Then 11 g (110 mmol) triethylamine was added dropwise over 10 minutes and the mixture stirred overnight. Treatment with dilute hydrochloric acid, extractive workup, and purification through silica gel yielded 5.3 g S-12 acid, confirmed by elemental analysis, nmr, infrared and mass spectra. A suspension of 5 g (11 mmol) S-12 acid in 150 ml dichloromethane was treated with 2.77 g (22 mmol) oxalyl chloride and 10 drops dimethylformamide, stirred 30 minutes, and concentrated to yield S-13 as a yellow-brown solid.

B. Preparation of phenolic coupler moiety

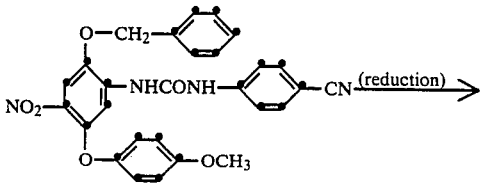

(S-4)

-continued

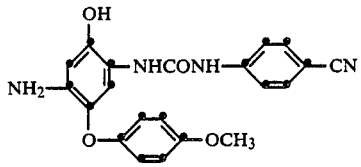

(S-5)

C. Coupler formation

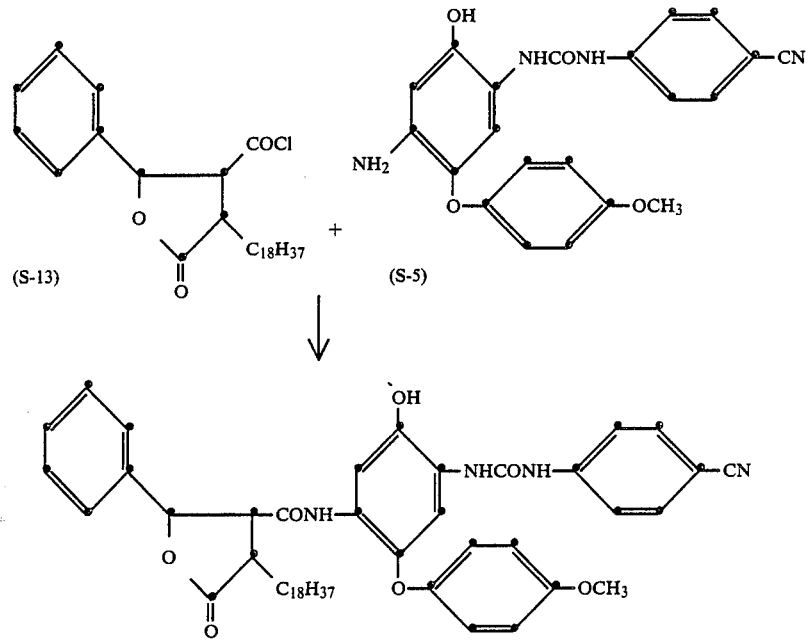

Coupler Compound No. 6

Preparation of phenolic coupler moiety and Coupler Compound No. 6

A suspension of 5.5 g (11 mmol) S-4 nitrobenzyl ether (prepared as described above in Synthesis 1) in 150 ml ethyl acetate was shaken overnight with 2.1 g 10% palladium on carbon catalyst and 1 ml acetic acid under 40 lb hydrogen pressure to provide the aminophenol S-5. Then, under nitrogen, 4 g (33 mmol) dimethylaniline and 11 mmol S-13 acid chloride were added and stirring continued 30 minutes. Removal of catalyst by filtration followed by hydrochloric acid washing, purification through silica gel, and crystallization from acetonitrile yielded 4.5 g white solid Coupler Compound No. 6, m.p. 120°-122°. Identity of the product was confirmed by its elemental analysis and infrared spectrum.

Other coupler compounds of this invention were prepared by analogous routes.

The cyan dye-forming couplers of this invention can be used in the ways and for the purposes that cyan dye-forming couplers are used in the photographic art. Typically, the couplers are incorporated in silver halide emulsions and the emulsions coated on a support to form a photographic element. Alternatively, the couplers can be incorporated in photographic elements adjacent the silver halide emulsion where, during development, the coupler wil be in reactive association with development products such as oxidized color developing agent.

As used herein, the term "associated therewith" signifies that the coupler is in the silver halide emulsion layer or in an adjacent location were, during processing, it is capable of reaction with silver halide development products.

The photographic elements can be either single color or multicolor elements. In a multicolor element, the cyan dye-forming coupler of this invention is usually associated with a red-sensitive emulsion, although it could be associated with an unsensitized emulsion or an emulsion sensitized to a different region of the spectrum. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, at least one of the cyan dye-forming couplers being a coupler of this invention, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the elements of this invention, reference will be made to Research Disclosure, December 1978, Item 17643, published by Industrial Opportunities Ltd., Homewell Havant, Hampshire P09 1EF, U.K., the disclosures of which are incorporated herein by reference.

This publication will be identified hereafter by the term "Research Disclosure."

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publication cited therein.

In addition to the couplers described herein the elements of this invention can include additional couplers as described in Research Disclosure Section VII, paragraphs D, E, F and G and the publications cited therein. These additional couplers can be incorporated as described in Research Disclosures of Section VII, paragraph C and the publications cited therein.

The photographic elements of this invention can contain brighteners (Research Disclosure Section V), antifoggants and stabilizers (Research Disclosure Section VI), antistain agents and image dye stablilzers (Research Disclosure Section VII, paragraphs I and J), light absorbing amd scattering materials (Research Disclosure Section VIII), hardeners (Research Disclosure Section XI), plasticizers and lubricants (Research Disclosure Section XII), antistatic agents (Research Disclosure Section XIII), matting agents (Research Disclosure Section XIII), matting agents (Research Disclosure Section XVI) and development modifiers (Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methane-sulfonamido)ethyl-N,N-diethylaniline hydrochloride and 4-amino-N-ethyl-N-diethylaniline hydrochloride and 4-amino-N-ethyl-N-diethylaniline hydrochloride and 4-amino-N-ethyl-N-(2-methoxyethyl)-m-toluidine di-p-toluene sulfonic acid.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

In the following examples, a measure of each coupler's coupling effectiveness is represented by G, the ratio of its photographic dye image gamma (the slope of the sensitometric curve) to that of Control Coupler A, which is normalized to 1.0. Coupler A is identical to Coupler No. 7 of U.S. Pat. No. 4,333,999. Such normalization of the data compensates for coating and processing variations by relating the performance of each test coupler to that of a control coupler coated and processed at the same time and in the same manner. In these comparisons 2-equivalent couplers were coated at one-half the silver level of 4-equivalent couplers.

Processing and testing procedures were kept constant. Hue measurements on a normalized spectral absorption curve included λmax (the peak absorption wavelength) and HBW (the half bandwidth). The HBW value serves to indicate hue purity. Dye images of narrow HBW and of λmax>677 are at least likely to have unwanted absorption tailing into the green region. Particularly useful couplers provided dye images with G>1.00, λmax>677 nm and HBW<148 nm.

The following examples further illustrate this invention.

EXAMPLE 1

Photographic elements were prepared by coating a cellulose acetate-butyrate film support with a photosensitive layer containing a silver bromoiodide emulsion at 0.91 g Ag/m$^2$, (half this level for 2-equivalent couplers), gelatin at 3.78 g/m$^2$, and a cyan phenolic coupler, as identified below, dispersed in one-half its weight of di-n-butyl phthalate and coated at $1.62\times10^{-3}$ mole/m$^2$. The photosensitive layer was overcoated with a layer containing gelatin at 1.08 g/m$^2$ and the hardener compound bis-vinylsulfonylmethyl ether at 1.75 weight percent based on total gelatin.

Samples of each element were imagewise exposed through a graduated-density test object and processed at 40° C. employing the following color developing solution, then stopped, bleached with a ferric EDTA solution, fixed, and washed to produce stepped cyan dye images.

| | |
|---|---|
| $K_2SO_3$ | 2.0 g |
| $K_2CO_3$ (anhydrous) | 30.0 g |
| KBr | 1.25 g |
| KI | 0.6 g |
| 4-Amino-3-methyl-N—ethyl N—β-hydroxyethylaniline sulfate | 3.55 g |
| Water to 1.0 liter | pH 10.0 |

The results are presented in Table II below:

TABLE II

| | G | λmax (nm) | HBW (nm) |
|---|---|---|---|
| Coupler A (control) | 1.00 | 690 | 140 |
| Coupler B (comparison) | 1.47 | 675 | 134 |
| Coupler C (comparison) | 1.54 | 649 | 142 |
| Coupler 1 (invention) | 1.04 | 678 | 147 |
| Coupler 5 (invention) | 1.34 | 690 | 147 |
| Coupler 6 (invention) | 1.28 | 698 | 133 |

The structural formulae for the comparison couplers noted above are as follows:

Coupler A: (Coupler No. 7 in U.S. Pat. No. 4,333,999)

-continued

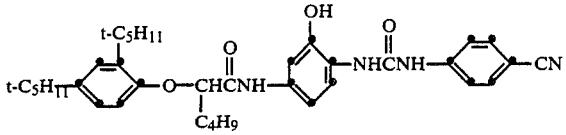

Coupler B: (Coupler No. 1 in U.S. Pat. No. 4,333,999)

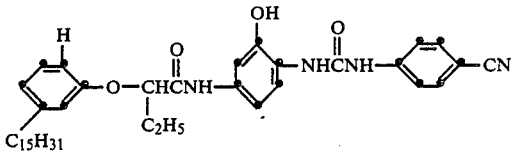

Coupler C:

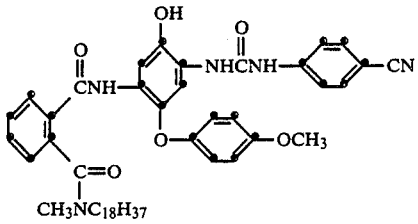

It can be seen from the data in Table II that comparison Couplers B and C do not provide the desirable long wavelength absorbing dyes while Coupler A is lacking in coupling effectiveness. Couplers 5 and 6 of this invention, on the other hand, have very good coupling effectiveness while simultaneously providing dyes of desirable hue. Coupler 1 shows smaller improvements over the comparison couplers. It is noteworthy that comparison Coupler C, having an aromatic ring ballast group instead of the alicyclic or heterocyclic ring ballast of the inventive couplers, produces a dye absorbing 30 or 50 nm hypsochromic of the desired range.

This invention has been described in detail with particular reference to preferred embodiments thereof, but it will be understood that variations and modifications can be effected within the spirit and scope of the invention.

What is claimed is:

1. A photographic element comprising a support and a photosensitive silver halide emulsion which has associated therewith a cyan dye-forming coupler compound having the structural formula:

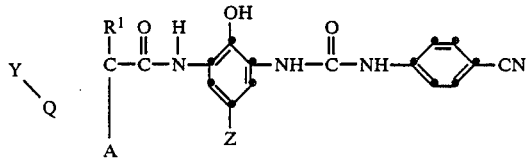

wherein:

$R^1$ is hydrogen or an unsubstituted or substituted alkyl group having from 1 to about 20 carbon atoms;

Q represents the nonmetallic atoms needed to complete an alicyclic or heterocyclic ring system which comprises 1 to 3 rings each having from 4 to 7 atoms in the ring;

A, which represents a ring member bonded to the same carbon atom as is $R^1$, is either

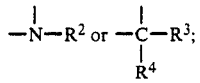

$R^2$ is an unsubstituted or substituted alkyl group having from 1 to about 24 carbon atoms, a cycloalkyl group having from 3 to 8 carbon atoms in the ring, an aryl group having from 6 to about 24 carbon atoms, or a heterocyclic group having from 3 to 8 atoms in the heterocyclic ring where the hetero ring atoms can be nitrogen, oxygen or sulfur, or $R^2$ is $L—R^5$;

$R^3$ is as defined for $R^2$ or is halogen with the proviso that when Q completes a cyclohexyl ring, $R^3$ is $L—R^5$;

$R^4$ is as defined for $R^2$ or is hydrogen or halogen;

$R^5$ is an unsubstituted or substituted alkyl group having from 1 to about 24 carbon atoms, a cycloalkyl group having from 3 to 8 carbon atoms in the ring, an aryl group having from 6 to about 24 carbon atoms, or a heterocyclic group having from 3 to 8 atoms in the heterocyclic ring where the hetero ring atoms can be nitrogen, oxygen or sulfur, L is —CO—, —COO—, $—SO_2—$, $—CONR^6—$ or $—SO_2NR^6—$;

$R^6$ is as defined for $R^5$ or is hydrogen;

Y represents one or more substituents which individually can be halogen, hydroxy, amino, including substituted amino where one or both hydrogen atoms are replaced with an alkyl group having from 1 to about 10 carbon atoms or with an aryl group having from 6 to about 10 carbon atoms, cyano, nitro, carboxy, sulfo, or is as defined for $R^2$; and Z is hydrogen or a coupling-off group.

2. The photographic element of claim 1 wherein $R^1$ is hydrogen.

3. The photographic element of claim 1 wherein $R^1$ is an alkyl group having from 1 to about 12 carbon atoms.

4. The photographic element of claim 1 wherein $R^1$ is an alkyl group having from 1 to 3 carbon atoms.

5. The photographic element of claim 1 wherein Q represents carbon, oxygen and nitrogen atoms sufficient to complete a 5 or 6 membered ring.

6. The photographic element of claim 1 wherein A is

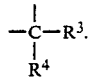

7. The photographic element of claim 1 wherein Q and A together complete a cyclohexyl or a butyrolactone ring.

8. The photographic element of claim 1 wherein Z is hydrogen or

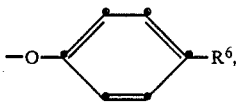

where $R^6$ is an alkyl or an alkoxy group having from 1 to about 10 carbon atoms.

9. The photographic element of claim 1 wherein the cyan dye-forming coupler compound has the structural formula:
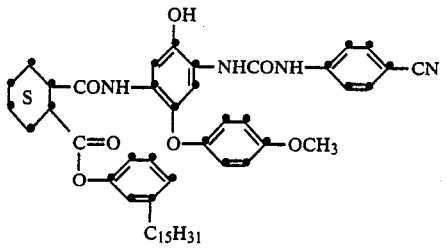
10. The photographic element of claim 1 wherein the cyan dye-forming coupler compound has the structural formula:
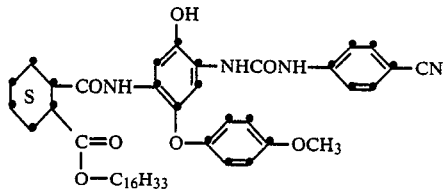
11. The photographic element of claim 1 wherein the cyan dye-forming coupler copound has the structural formula:
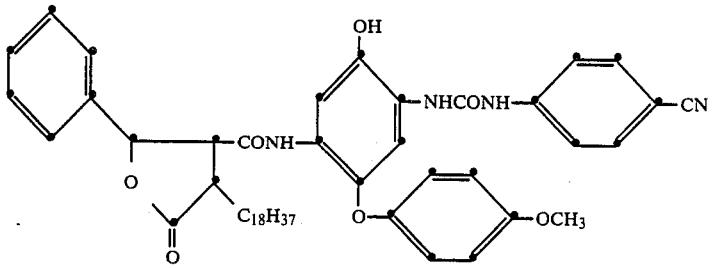
* * * * *